US008707743B2

(12) United States Patent
Bae et al.

(10) Patent No.: US 8,707,743 B2
(45) Date of Patent: Apr. 29, 2014

(54) WASHING MACHINE

(75) Inventors: Sang Hun Bae, Changwon-si (KR); Dong Yoon Kim, Changwon-si (KR); Chul Jin Choi, Changwon-si (KR); Dong Hyun Kim, Changwon-si (KR); Young Bok Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1000 days.

(21) Appl. No.: 12/309,823

(22) PCT Filed: Aug. 1, 2007

(86) PCT No.: PCT/KR2007/003709

§ 371 (c)(1),
(2), (4) Date: May 20, 2009

(87) PCT Pub. No.: WO2008/016262

PCT Pub. Date: Feb. 7, 2008

(65) Prior Publication Data

US 2009/0260406 A1 Oct. 22, 2009

(30) Foreign Application Priority Data

Aug. 2, 2006 (KR) ..... 10-2006-0072899
Jul. 31, 2007 (KR) ..... 10-2007-0077010

(51) Int. Cl.
*D06F 39/02* (2006.01)
*D06F 58/28* (2006.01)

(52) U.S. Cl.
USPC ..... 68/15; 68/17 R; 34/597

(58) Field of Classification Search
USPC ..... 68/5 C, 15, 17 R; 34/60, 595, 596, 597
See application file for complete search history.

(56) References Cited

U.S. PATENT DOCUMENTS

| | | | | | |
|---|---|---|---|---|---|
| 2,562,843 | A * | 7/1951 | Grondahl | 392/312 |
| 4,207,683 | A * | 6/1980 | Horton | 34/60 |
| 5,337,703 | A * | 8/1994 | Schlesch et al. | 122/379 |
| 6,031,969 | A * | 2/2000 | Burr et al. | 392/404 |
| 6,986,217 | B2 * | 1/2006 | Leung et al. | 38/77.83 |
| 2005/0262644 | A1 * | 12/2005 | Oak et al. | 8/158 |
| 2007/0151312 | A1 * | 7/2007 | Bruce et al. | 68/3 R |
| 2008/0000098 | A1 * | 1/2008 | Choi et al. | 34/114 |

FOREIGN PATENT DOCUMENTS

| | | | |
|---|---|---|---|
| DE | 43 04 532 | A1 | 8/1994 |
| EP | 1441058 | A1 * | 7/2004 |
| EP | 1441059 | A1 * | 7/2004 |
| EP | 1 600 545 | A1 | 11/2005 |
| JP | 2002-315995 | | 10/2002 |
| KR | 10-20040071734 | A | 8/2004 |
| KR | 10-2005-0018183 | A | 2/2005 |
| KR | 10-0672439 | B1 | 1/2007 |
| KR | 10-0698133 | B1 | 3/2007 |
| KR | 10-20070051589 | A | 5/2007 |
| KR | 10-20070066221 | A | 6/2007 |
| WO | WO 03/057970 | A1 | 7/2003 |

* cited by examiner

*Primary Examiner* — Joseph L Perrin
(74) *Attorney, Agent, or Firm* — McKenna Long & Aldrdige LLP

(57) ABSTRACT

The present invention relates to a laundry machine using steam. The laundry machine includes a drum for holding laundry, a steam generator for generating steam, a water supply unit for supplying water to the steam generator, an additive supply unit for supplying additive to the steam generator, and a supply line for supplying the steam and the additive to the drum.

20 Claims, 5 Drawing Sheets

WASHING MACHINE

This application is a 35 U.S.C. §371 National Stage entry of International Application No. PCT/KR2007/003709, filed on Aug. 1, 2007, and claims priority to Korean Application Nos. KR 106-2006-0072899, filed on Aug. 2, 2006 and KR 10-2007-0077010, filed Jul. 31, 2007, both of which they are hereby incorporated by reference in their entireties.

TECHNICAL FIELD

The present invention relates to laundry machines. Mere specifically, the present invention relates to a laundry machine which treats laundry with steam.

BACKGROUND ART

Generally, in the laundry machines, there are washing machines for washing laundry, and dryers for drying a drying object. In view of convenience, both the laundry and the drying object will be called as laundry, collectively.

Recently, a product is spot-lighted, in which a steam generator is added to a washing machine, particularly, to a drum type washing machine for supplying steam to the laundry to improve a washing performance, and save energy. Along with this, there are various attempts underway, in which the steam generator is added, not only to the drum type washing machine, but also to the laundry machine, particularly to a drum type dryer, for supplying the steam to the laundry to remove creases, or odor from the laundry.

In the meantime, keeping pace with improvement of a quality of life, necessities are brought forward, in which the laundry machine performs, not only the washing or drying of the laundry merely, but also performs extra functions.

For an example, a necessity is brought forward, in which the laundry machine performs an extra function so that the laundry has aroma after the washing or drying. Also, necessities are brought forward, in which the laundry machine performs extra functions so that effective sterilizing, bleaching, eliminostating, or the like can be made, better than a case when merely detergent is used.

Of course, separate from the detergent, it is also possible to supply additives to a drum for above extra functions for the aroma or the sterilizing. However, in this case, it is a problem in which a function of the additive itself can not be displayed effectively, because the additive is supplied to the drum with the additive mixed with the detergent or waster.

Moreover, it is a problem in which many additional devises are required for supplying the additive to the drum separate from the detergent or water. For an examine, in order to spray aromatic additive to the drum, an aroma spraying unit, an additive case, a pipe or a tube, and a pump for generating energy or a pressure required for the spray, and so on are required, additionally.

DISCLOSURE OF INVENTION

Technical Problem

However, in this case, it is a problem in which a function of the additive itself can not be displayed effectively, because the additive is supplied to the drum with the additive mixed with the detergent or waster.

Moreover, it is a problem in which many additional devises are required for supplying the additive to the drum separate from the detergent or water. For an example, in order to spray aromatic additive to the drum, an aroma spraying unit, an additive case, a pipe or a tube, and a pump for generating energy or a pressure required for the spray, and so on are required, additionally.

Technical Solution

To solve the problems, an object of the present invention is to provide a laundry machine in which functional additives other than detergent can be supplied to laundry easily for effective display of a function of the additive itself.

Another object of the present invention is to provide a laundry machine in which additive can be supplied to laundry by using large portions of a related art laundry machine only with least addition of devices.

Another object of the present invention is to provide a laundry machine in which functional additives can be supplied to laundry easily without making large change to a related art steam generator, or a control algorithm.

To achieve these objects and other advantages and in accordance with the purpose of the invention, as embodied and broadly described herein, a laundry machine includes a drum for holding laundry, a steam generator for generating steam, a water supply unit for supplying water to the steam generator, an additive supply unit for supplying additive to the steam generator, and a supply line for supplying the steam and the additive to the drum.

The additive supply unit supplies liquidus additive, functional additives at least for acceleration of activity of detergent, sterilization, or bleaching. In this instance, it is preferable that the additive supply unit supplies additives having no surfactant.

The additive is mixed with steam before being supplied to the drum.

The water supply unit includes a water supply valve for selective supply of water to the steam generator, and the water supply valve also supplies the water to the additive supply unit. The laundry machine further includes a valve between the water supply valve and the additive supply unit for selective supply of the water to the additive supply unit through the water supply valve.

Different from this, the additive supply unit includes an additive introduction unit for holding the additive, and a pump for supplying the additive to the steam generator.

The laundry machine further includes a controller for controlling operation of the laundry machine including operation of the water supply unit, and the additive supply unit, and a control panel for interface with the user. Particularly, the control panel is provided with a selection unit for user's selection of various washing courses, or drying courses, and the various washing courses, or drying courses include a steam course having a steam course for supplying the steam to the drum upon user's selection.

Upon user's selection of the steam course at the selection unit, the controller controls operation of the steam generator and the additive supply unit so that the steam and the additive are mixed, and supplied to the drum.

Moreover, the selection unit further includes an additive selection unit, and, only when the user selects the additive selection unit, the controller controls operation of the steam generator and the additive supply unit so that the steam and the additive are mixed, and supplied to the drum.

The water supply unit includes a detachable water container for supplying water to the steam generator, and a water supply flow passage connected between the steam generator and the water container, for flow of water, and the additive supply unit includes a supplementary tray for introduction of the additive to the steam generator together with the water from the water container.

The supplementary tray and the water container are connected to each other such that, when the water is supplied from the water container to the steam generator, the. additive is supplied from the supplementary tray to the steam generator, together with the water. Particularly, the supplementary tray is detachable from the water container.

The supplementary tray is mounted in the water container, or mounted to an outside of the water container.

The water container includes a container for holding water, and a cover for covering the container, and the supplementary tray is detachable from the cover, or from the container.

Advantageous Effects

The present invention has following advantageous effects.

First, formation of crumple or creases on a dried drying object can be prevented effectively, or crumple or creases formed on the dried drying object can be removed, effectively.

Second, crumple or creases can be removed from dried laundry without pressing.

Third, the spray of additive through a steam generator can maximize a wetting effect of the additive to the laundry.

Fourth, the additive can be sprayed to the laundry easily without addition of many devices to the related art laundry machine and algorithm thereof.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

Though there can be various kinds of laundry machines, such as washing machines, dryers, and washing and drying machine, for convenience of description, the washing machine will be taken as an example in the following description.

Figure 1:
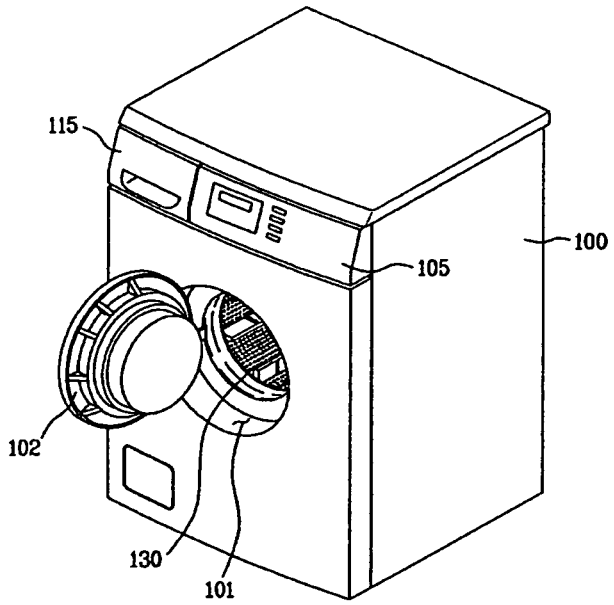
FIG. 1 illustrates a perspective view of a laundry machine in accordance with a preferred embodiment of the present invention.
Figure 2:
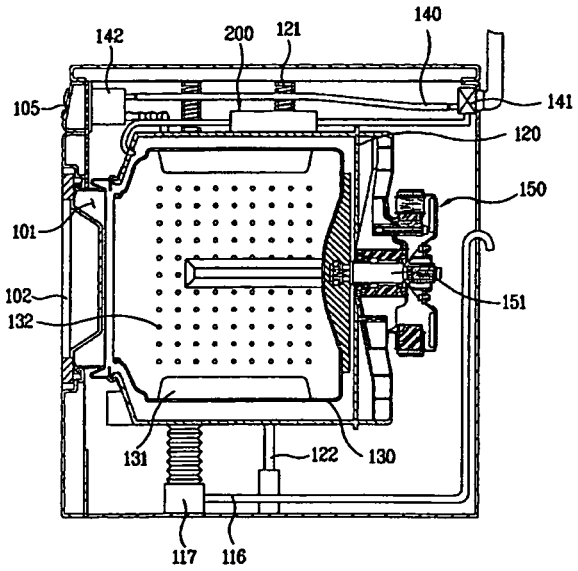
FIG. 2 illustrates a section of the laundry machine in FIG. 1.

Referring to FIGS. 1 and 2, the laundry machine includes a body 100 with an opened top, which forms an exterior, and a door 102 for swing open/close of a laundry opening 101 in a front of the body 100.

Provided in the body 100, there are a tub 120 suspended with springs 121 and dampers 122, and a drum 130 rotatably mounted in the tub 120. The drum 130 has lifters 131 on an inside circumference for lifting the laundry introduced to the drum 130 to a predetermined height, and a plurality of pass through holes 132 for escaping of washing water from the drum 130 in a washing course, such as spinning, or the like.

On an upper side of the tub 120, there are a water supply hose 140 for supply of water to the tub 120 from an external water source, a water supply valve 141 on the water supply hose 140 for controlling in/out of the water, and a detergent supply unit 142 for introducing the water from the water supply hose 140 to the tub 120 together with the detergent. Mounted under the tub 110, there are a drain hose 116 and a drain pump 117 for draining washing water used in washing or rinsing to an outside of the laundry machine.

Mounted to a rear of the tub 110, there is a motor 150 connected to the drum 130 through a rotation shaft 151 for rotating the drum 130.

On an upper side of the front of the body 100, there is a control panel 105 for displaying an operation state of the laundry machine as well as controlling the operation of the laundry machine.

In the meantime, in view of a principle of washing with water, creases are formed on the laundry washed with water, and the creases are not eliminated even if the laundry is dried at the laundry machine, to require pressing additionally on the laundry. Besides the washed laundry, creases, crumples, and folds (hereafter called as crumple collectively) are formed even when clothes are stored, or used, conventionally.

In order to enhance washing efficiency of the laundry, a steam generator 200 is provided for spraying steam to the drum.

Figure 3:
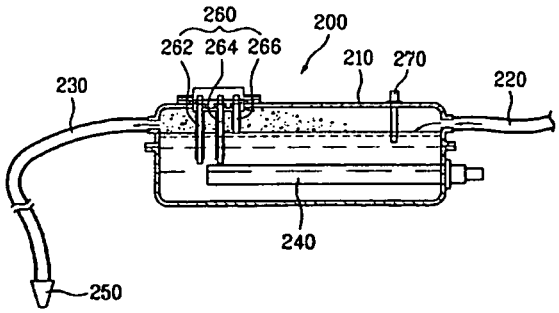
FIG. 3 illustrates a section of the steam generator in FIG. 1.

The steam generator 200 will be described with reference to FIG. 3.

The steam generator 200 includes a water tank 210 for holding water, a heater 240 mounted in the water tank 210, a water level sensor 260 for measuring a water level of the water tank 210, and a temperature sensor 270 for measuring a temperature of the water in the water tank 210.

The water level sensor 260 in general has a common electrode 262, a low water level electrode 264, and a high water level electrode 264 for sensing a high water level and a low water level according to electric conduction taken place between the common electrode 262 and the high water level electrode 264, and between the common electrode 262 and the low water level electrode 266, respectively.

The steam generator 200 has one side having a water supply flow passage 220 extended from the water supply valve 141 for supplying water, and the other side having a supply line connected thereto for supply steam. It is preferable that, at a fore end of the supply line 230, there is a nozzle 250 provided thereto for enhancing steam spray efficiency.

Figure 4:
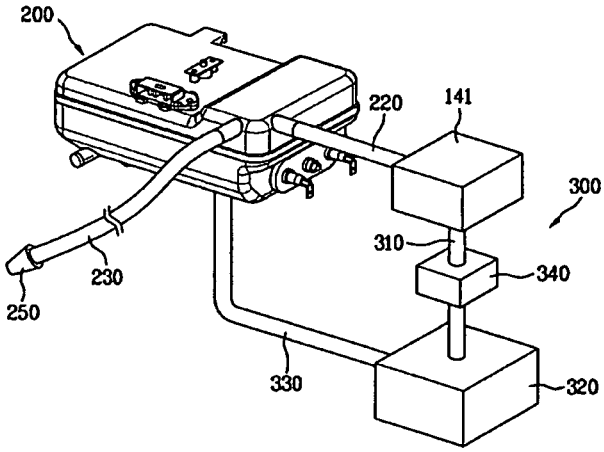
FIG. 4 illustrates a perspective view of the steam generator and the additive supply unit in FIG. 1.

FIG. 4 illustrates a perspective view of a water supply unit for supplying water to the steam generator 200.

Referring to FIG. 4, the water supply unit includes a water supply valve 141 connected to a water supply source, such as a tap which supplies water to the steam generator 200, for controlling in/out of water, and a water supply flow passage 220 extended from the water supply valve 141 for supplying water to the steam generator 200.

The laundry machine is provided with an additive supply unit 300 for supplying additive together with steam from the steam generator 200. The additive supply unit 300 sprays a functional additive for accelerating detergent activity, sterilizing or bleaching the laundry, or adding aroma to clothes, to the drum 130 through the steam generator 200. Thus, by making the additive to be supplied to the drum 130 together with steam through the steam generator 200, the additive can be sprayed to the laundry more uniformly.

For adding the additive to the drum 130 together with steam through the steam generator 200, the additive supply unit 300 includes a water supply pipe 310 extended from the water supply valve in addition to the water supply flow passage 220 connected to the steam generator 200, an additive introduction unit 320 connected to the water supply pipe 310 for introduction of the additive, and a water discharge pipe 330 connected between the additive introduction unit 320 and the steam generator 200 for discharging the additive to the steam generator 200.

The water supply pipe 310 has a valve 340 mounted thereon for controlling water being supplied to the additive introduction unit 320. It is preferable that the additive introduction unit 320 is of a drawer type for a user to introduce the additive thereto.

It is preferable that the water discharge pipe 330 extended from the additive introduction unit 320 to the steam generator 200 is in communication with a lower portion of the steam generator 200.

It is preferable that the additive introduced to the additive introduction unit 320 is of a liquid type, rather than of a powder type, so that the liquidus additive from the steam generator 200 is sprayed in a form of fine particles together with the steam for uniform wetting to the laundry in the drum 130.

Moreover, it is preferable that the additive is formed of a material including no surfactant under the following reason. The surfactant is a substance to be adsorbed to an interface in a thin solution of, such as detergent, serving to reduce surface tension. If the additive including the surfactant is introduced to the steam generator 200, a large amount of foam is formed in the steam generator 200 when the water boils in the steam generator 200. The large amount of foam formed in the steam generator 200 interferes supply of the steam from the steam generator 200 to the drum 130.

Figure 5:
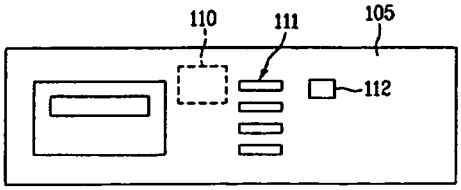
FIG. 5 illustrates a plan view of various selection units on a control panel.

In the meantime, FIG. 5 illustrates a plan view of the control panel 105 on the front of the laundry machine in FIG. 1, schematically.

The laundry machine of the present invention includes a controller 110 for controlling operation of the laundry machine including operation of the water supply unit and the additive supply unit 300, and the control panel 105 for interfacing with the user.

The control panel 105 had selection units 111 for the user to select one from various washing courses, or one from various drying courses. In the meantime, the washing course, or the drying course includes a steam course having a steaming step in which the steam is supplied to the drum 130 upon user's selection. Thus, the user can selects the washing course, or the drying course as necessary.

In the meantime, the selection unit 111 includes an additive selection unit 112 for the user to select spray of the additive to the drum.

The operation of the laundry machine will be described.

If the user selects the steam course at the selection unit 111, the controller 110 controls the water supply valve 141 and the steam generator 200, to generate steam at the steam generator 200. Particularly, if the user desires to spray the additive together with the steam, the user can select the additive selection unit 112. When the user selects the additive selection unit 112, the controller 110 opens the valve 340, to supply water to the additive introduction unit 320. If water is supplied to the additive introduction unit 320, the additive is introduced from the additive introduction unit 200 to the steam generator 200, and then the additive is introduced from the steam generator 200 to the drum 130 together with the steam from the steam generator 200.

Since the additive is sprayed together with the steam from the steam generator 200, the additive is sprayed to the laundry in the drum to display a function of the additive, effectively.

Moreover, the user is enabled to select a variety of modes by making the additive to be supplied through the steam generator 200 only when the user selects the additive selection unit 112. For an example, if the user selects the steam course without selecting the additive selection unit 112, since the controller 110 closes the valve 340, supplying no water to the additive introduction unit 320, the additive is not supplied to the drum 130, but only the steam is supplied to the drum.

Figure 6:
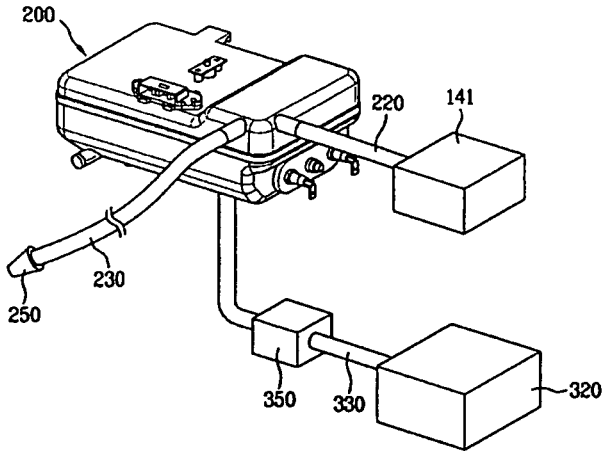
FIG. 6 illustrates a perspective view of a steam generator and an additive supply unit in accordance with another preferred embodiment of the present invention.

FIG. 6 discloses an additive supply unit in accordance with another preferred embodiment of the present invention.

Referring to FIG. 6, the additive supply unit 300 has no water supply pipe connected between the water supply valve 141 and the additive introduction unit 320. However, there is a pump 350 mounted on the water discharge pipe 330 connected between the additive introduction unit 320 and the steam generator 200.

In the meantime, the pump 350 is controlled by the controller 110.

The operation of the additive supply unit in FIG. 6 will be described.

When the user selects the steam course at the selection unit 111, the controller opens the water supply valve 141, to supply water to the steam generator 200 through the water supply flow passage 220. In the meantime, if the user selects the additive selection unit 112, the pump 350 comes into operation to supply the additive from the additive introduction unit 320 to the steam generator 200. Then, the additive is supplied from the steam generator 200 to the drum 113 in forms of fine particles together with the steam from the steam generator 200.

Figure 7:
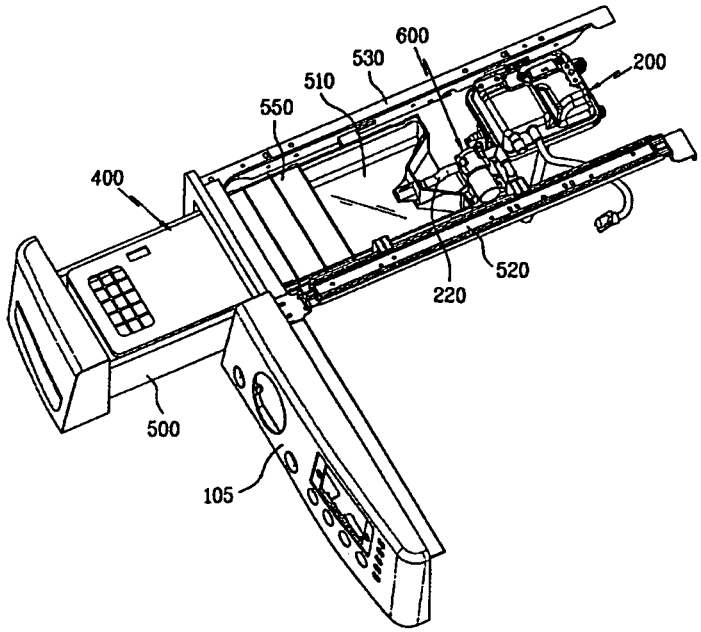
FIG. 7 illustrates a perspective view of a water supply unit and an additive supply unit in accordance with another system of water supply to a steam generator.

FIG. 7 illustrates an embodiment in which a water container is mounted to a water supply unit for the user to fill water to be supplied to the steam generator 200 personally without the steam generator 200 connected to a water source.

The steam generator 200 and a structure for supplying water to the steam generator 200 in accordance with a preferred embodiment of the present invention will be described.

It is preferable that a drawer type container (hereafter called as drawer) 500 is mounted to a laundry machine of the present invention, and a water container 400 is mounted to the drawer 500.

That is, rather than direct connection of the water container 400 to the water supply flow passage 220, indirect connection/disconnection of the water container 500 to/from the water supply flow passage 220 by mounting the water container 400 to the drawer 500 and pushing in/pulling out the drawer 500 is preferable.

It is preferable that the drawer is provided to a front of the laundry machine, for an example, to the control panel 105.

In more detail, a supporter 520 is mounted in rear of the control panel 105. That is, it is preferable that the supporter 520 is mounted parallel to a top frame 530 substantially, and a drawer guide 510 is mounted to the supporter 520 and the top frame 530 for guiding and supporting the drawer 500. It is more preferable that the drawer guide 510 has a top guide 550 at a portion of a top thereof.

The drawer guide 510 has an opened top and an opened one side (a front direction of the laundry machine) through which the drawer is to be pushed in/pulled out.

In the meantime, it is preferable that the water container 400 which supplies water to the steam generator 200 is detachable.

In a case the water tap is used as the water supply source, since addition of various devices incidental to the use of the water tap is required, it is very convenient that the detachable water container 400 is used, so that water is filled to the water container 400 detached from the water supply flow passage 220 of the steam generator 200, and the water container 400 having the water filled therein is attached to the water supply flow passage 220 of the steam generator 200.

It is preferable that a pump 600 is provided between the water container 400 and the steam generator 200. It is more preferable that the pump 600 is reversible so that water supply to, and recovery from, the steam generator 200 is possible.

In this instance, it is also possible that the water is supplied to the steam generator 200 by using a head difference between the water container 400 and the steam generator 200 without using the pump 600.

However, in general, since components of the laundry machine are standard parts designed compact, to result in lack of space absolutely, the water supply by using the head difference is actually impossible unless sizes of the components of the related art laundry machine are modified. Therefore, because the steam generator 200 can be mounted without changing the sizes of the components of the related art laundry machine if a small sized pump 600 is used, use of the pump 600 is very favorable.

The water remained in the steam generator 200 is recovered, because the remained water is liable to damage the heater, or dirty water is liable to be used later, if the steam generator 200 is left unused for a long time period.

It is preferable that the water is supplied to the steam generator 200 to a lower portion thereof and the steam is discharged from an upper portion of the steam generator 200, because this system is favorable for recovery of the remained water from the steam generator 200.

Variations of the water container 400 which supplies water to the steam generator 200 will be described in detail.

FIGS. 8 to 11 illustrate perspective views of variations of water supply units and additive supply units, respectively.

Figure 8:
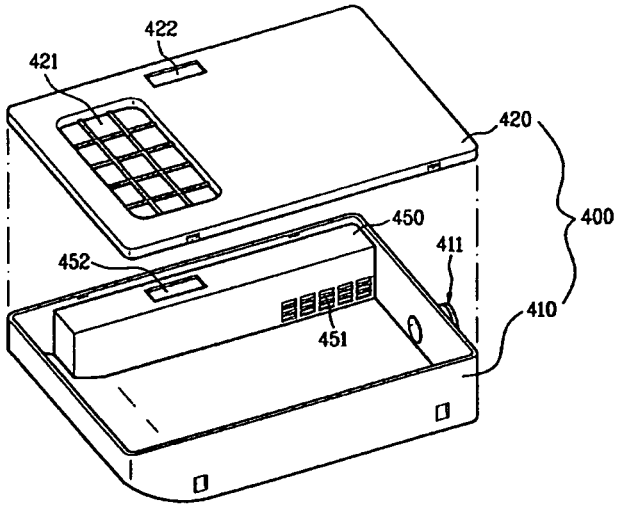
FIGS. 8 to 11 illustrate perspective views of variations of water supply units and additive supply units, respectively.

Referring to FIG. 8, the water container 400 includes a supplementary tray 450 for holding various additives, such as antistatic agent, aromatics, and so on. That is, the supplementary tray 450 serves as the additive supply unit.

The water container 400 includes a container 410 for holding the washing water, and a cover 420 for covering the container 410.

The container 410 has a drain hole 411 connected to the water supply flow passage 220 for draining the water, and the cover 420 has a water opening 421 and an additive opening 422 for introduction of the water and the additive without separating the cover 420 from the container 410, respectively. In the meantime, the supplementary tray 450 has an additive opening formed to match with the additive opening in the cover 420.

The supplementary tray 450 and the water container 400 are mounted to form a structure in communication with each other so that the additive introduced to the supplementary tray 450 is supplied to the steam generator 200 together with the water introduced to the water container 400.

In this case, there may be a variety of shapes of the connection structure of the supplementary tray 450 to the water container 400 as shown in FIGS. 8 to 11.

First, referring to FIG. 8, the supplementary tray 450 has an outlet 451 for moving the additive from the supplementary tray 450 to the water container 400, and therefrom to the steam generator 200 together with water. It is preferable that the outlet 451 can be opened/closed with the controller 110.

It is preferable that the supplementary tray 450 is detachable from the water container 400, by using general press fit or screw fastening.

Figure 9:
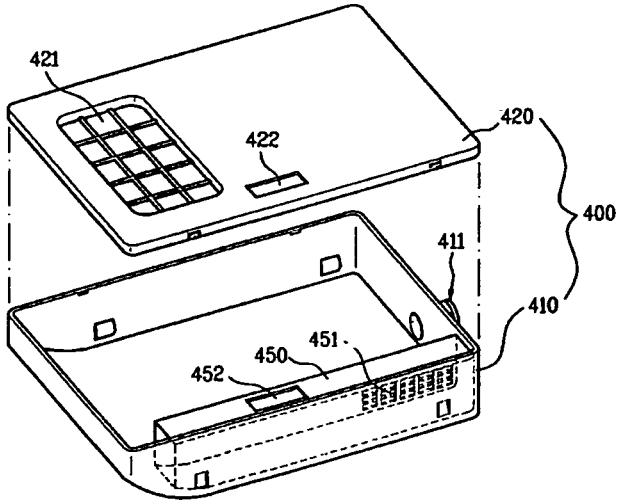

In the meantime, referring to FIG. 9, it is apparent that the supplementary tray 450 can be placed opposite to a location in FIG. 8.

Figure 10:
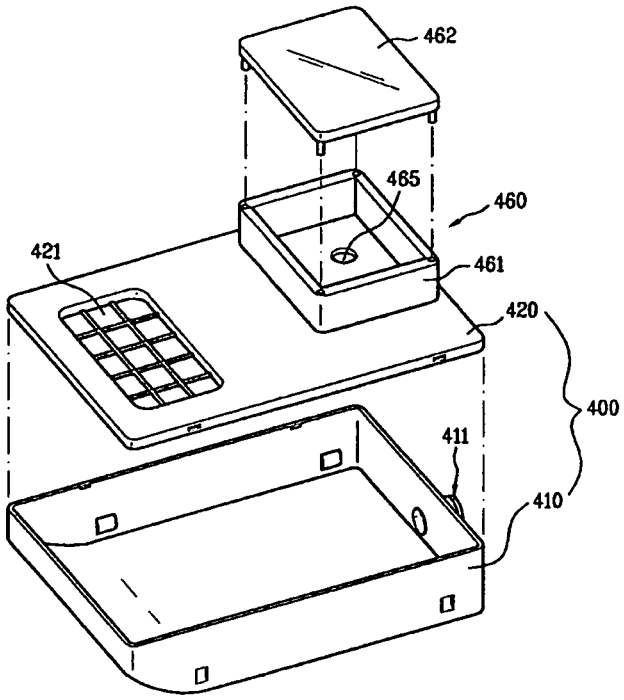
Figure 11:
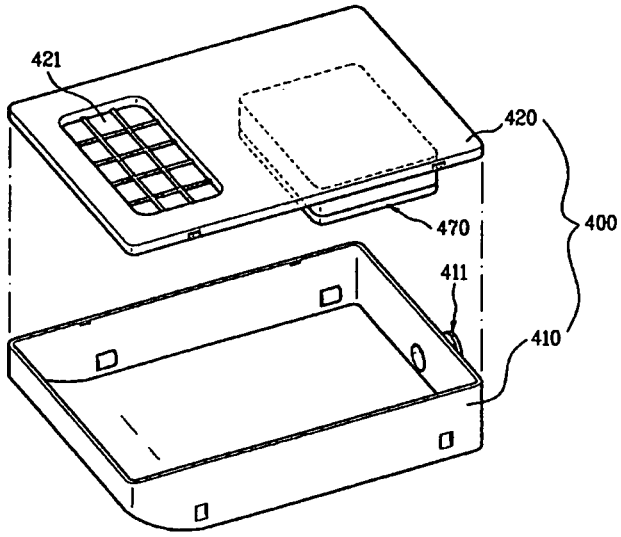

Referring to FIGS. 8 and 9, though the supplementary tray can be placed in the water container 400, as shown in FIGS. 10 and 11, the supplementary tray may be placed on an outside of the water container 400.

That is, referring to FIGS. 10 or 11, the water container 400 includes a container 410 for holding washing water, and a cover 420 for covering the container 410, wherein the supplementary tray 460, or 470 is designed detachable from the cover 420.

Referring to FIG. 10, the supplementary tray 460 includes a case 461 projected outward from the cover 420 to form a space for holding the additive, and a cover 462 for covering the case 461. In the meantime, the case 461 has a communication hole 465 for introducing the additive from the case 461 to the container.

The operation of the water containers 400 in FIGS. 8 to 11 will be described.

The washing water is filled in the water container 400, and various additives are filled in the supplementary trays 460, respectively. Then, the washing water is transferred from the water container 400 to the steam generator 200 through the water supply flow passage 220. In this instance, since the supplementary tray 460 is connected to the water container 400, various additives move to the steam generator 200 together with water, and introduced into the drum 130.

In this case, it is preferable that the connection portion 451 between the supplementary tray 460 and the water container 400 can be opened/closed, so that the additives are introduced from the supplementary tray 460 to the steam generator only when required.

Though the present invention has been described taking a laundry machine as an example, the water supply unit and the additive supply unit of the present invention are applicable not only to the washing machine, but also to a washing and drying machine, and a dryer.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The laundry machine of the present invention has the following industrial applicability. Formation of crumple or creases on a dried drying object can be prevented effectively, or crumple or creases formed on the dried drying object can be removed, effectively. Crumple or creases can be removed from dried laundry without pressing. The spray of additive through a steam generator can maximize a wetting effect of the additive to the laundry. The additive can be sprayed to the laundry easily without addition of many devices to the related art laundry machine and algorithm thereof.

The invention claimed is:

1. A laundry machine comprising:

a drum for holding laundry;

a steam generator for generating steam;

a water supply unit for supplying water to the steam generator, wherein the water supply unit includes a water container for holding water and a water supply flow passage connecting the steam generator with the water container;

an additive supply unit for supplying additive to the steam generator, wherein the additive supply unit includes a supplementary tray for storing the additive and the supplementary tray is provided inside of the water container;

a supply line for supplying the steam and the additive to the drum; and a drawer that is provided to a front of the laundry machine, wherein the additive stored in the supplementary tray is supplied to the steam generator together with the water stored in the water container when the water is supplied from the water container to the steam generator through the water supply flow passage, and wherein the water container is detachably mounted to the drawer, and the water container is connected to the water supply flow passage when the drawer in pushed in the laundry machine and the water container is disconnected from the water supply flow passage when the drawer is pulled out from the laundry machine.

2. The laundry machine as claimed in claim 1, wherein the additive supply unit supplies liquidus additive.

3. The laundry machine as claimed in claim 2, wherein the additive supply unit supplies functional additives for acceleration of activity of detergent, sterilization, or bleaching.

4. The laundry machine as claimed in claim 2, wherein the additive supply unit supplies additives having no surfactant.

5. The laundry machine as claimed in claim 1, wherein the additive is mixed with steam before being supplied to the drum.

6. The laundry machine as claimed in claim 1, wherein the water supply unit includes a water supply valve for selective supply of water to the steam generator, and the water supply valve also supplies the water to the additive supply unit.

7. The laundry machine as claimed in claim 6, further comprising a valve between the water supply valve and the additive supply unit for selective supply of the water to the additive supply unit through the water supply valve.

8. The laundry machine as claimed in claim 1, wherein the additive supply unit includes; an additive introduction unit for holding the additive, and a pump for supplying the additive to the steam generator.

9. The laundry machine as claimed in claim 1, further comprising a controller for controlling operation of the laundry machine including operation of the water supply unit, and the additive supply unit; and a control panel for interface with the user.

10. The laundry machine as claimed in claim 9, wherein the control panel is provided with a selection unit for user's selection of various washing courses, or drying courses.

11. The laundry machine as claimed in claim 10, wherein the various washing courses, or drying courses include a steam course having a steam course for supplying the steam to the drum upon user's selection.

12. The laundry machine as claimed in claim 11, wherein, upon user's selection of the steam course at the selection unit, the controller controls operation of the steam generator and the additive supply unit so that the steam and the additive are mixed, and supplied to the drum.

13. The laundry machine as claimed in claim 9, wherein the selection unit further includes an additive selection unit.

14. The laundry machine as claimed in claim 13, wherein, only when the user selects the additive selection unit, the controller controls operation of the steam generator and the additive supply unit so that the steam and the additive are mixed, and supplied to the drum.

15. The laundry machine as claimed in claim 1, wherein the supplementary tray is detachable from the water container.

16. The laundry machine as claimed in claim 1, wherein the water container includes;

a container for holding water;

a drain hole provided in the container and connected to the water supply passage, and a cover for covering the container, wherein the supplementary tray is detachably mounted on the container.

17. The laundry machine as claimed in claim 16, wherein the supplementary tray is detachable from the cover.

18. The laundry machine as claimed in claim 16, wherein the supplementary tray includes an outlet for moving the additive from the supplementary tray to the container and an additive opening, and the cover includes a water opening for introducing water into the container and an additive opening corresponding to the additive opening of the supplementary tray.

19. The laundry machine as claimed in claim 1, wherein the water supply unit further includes a pump on the water supply flow passage for pimping the water and the additive to the steam generator.

20. The laundry machine as claimed in claim 1, wherein the laundry machine is a dryer.

* * * * *